US010861357B2

(12) United States Patent
Touidjine-Williams et al.

(10) Patent No.: US 10,861,357 B2
(45) Date of Patent: Dec. 8, 2020

(54) ATHLETIC BIB

(71) Applicant: NIKE, Inc., Beaverton, OR (US)

(72) Inventors: Scott E. Touidjine-Williams, Portland, OR (US); Peter G. Kramer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 127 days.

(21) Appl. No.: 15/345,892

(22) Filed: Nov. 8, 2016

(65) Prior Publication Data

US 2017/0140681 A1 May 18, 2017

Related U.S. Application Data

(60) Provisional application No. 62/254,887, filed on Nov. 13, 2015.

(51) Int. Cl.

| | |
|---|---|
| ***G09F 21/02*** | (2006.01) |
| ***A41D 27/08*** | (2006.01) |
| ***G09F 7/02*** | (2006.01) |
| ***A41D 31/102*** | (2019.01) |
| ***G09F 3/02*** | (2006.01) |
| ***G09F 3/10*** | (2006.01) |
| ***G09F 7/18*** | (2006.01) |
| ***G09F 23/00*** | (2006.01) |

(52) U.S. Cl.

CPC ..... *G09F 21/026* (2013.01); *A41D 27/08* (2013.01); *A41D 31/102* (2019.02); *G09F 3/02* (2013.01); *G09F 3/10* (2013.01); *G09F 7/02* (2013.01); *G09F 7/18* (2013.01); *G09F 23/00* (2013.01); *G09F 2003/0269* (2013.01); *G09F 2003/0282* (2013.01); *G09F 2007/1873* (2013.01)

(58) Field of Classification Search

CPC ..... G09F 21/026; G09F 2003/0225; G09F 2003/0236

USPC ..... 40/586, 602; D2/853, 861; D11/155, D11/168; D20/27

See application file for complete search history.

(56) References Cited

U.S. PATENT DOCUMENTS 308,244 A 11/1884 Fishel
2,685,690 A * 8/1954 Chrisman ..... G09F 21/02 2/1

(Continued)

FOREIGN PATENT DOCUMENTS

| | | |
|---|---|---|
| EP | 1634508 A2 | 3/2006 |
| GB | 631051 A | 10/1949 |
| WO | 2009123205 A1 | 10/2009 |

OTHER PUBLICATIONS

Translation of JP 2009244680, Oct. 2009.*

(Continued)

*Primary Examiner* — Joanne Silbermann

(74) *Attorney, Agent, or Firm* — Shook, Hardy and Bacon LLP

(57) ABSTRACT

Aspects herein provide for an athletic bib configured to be worn during athletic activities. In exemplary aspects, the athletic bib may be formed of a knit material comprising a plurality of perforations. The athletic bib may further comprise a releasable adhesive that is selectively applied to the surface of the athletic bib that is configured to be applied to an apparel item. The result of this configuration is an athletic bib that is able to closely conform to a wearer's body shape while still providing breathability and permeability.

16 Claims, 6 Drawing Sheets

(56) References Cited

U.S. PATENT DOCUMENTS

| | | | | |
|---|---|---|---|---|
| 2,781,820 | A | 2/1957 | Rogers | |
| 3,484,974 | A | 12/1969 | Culmone | |
| 4,277,848 | A | 7/1981 | Boehland | |
| 4,924,613 | A | 5/1990 | Levin | |
| 4,971,644 | A | 11/1990 | Mahn et al. | |
| 5,411,783 | A | 5/1995 | Mahn et al. | |
| 5,507,042 | A | 4/1996 | van der Slessen | |
| 5,581,815 | A | 12/1996 | Hans | |
| 5,632,044 | A | 5/1997 | Sloot | |
| 5,737,775 | A | 4/1998 | Schwartz et al. | |
| 5,943,697 | A | 8/1999 | Poskanzer | |
| 6,276,725 | B1 * | 8/2001 | Laurash | G09F 3/0292 206/459.1 |
| 6,883,178 | B2 | 4/2005 | van der Sleesen | |
| 7,005,170 | B1 | 2/2006 | Simpson et al. | |
| 7,378,141 | B2 | 5/2008 | Polegato Moretti | |
| 8,133,824 | B2 | 3/2012 | Harber | |
| 8,857,085 | B1 * | 10/2014 | Lewis | G09F 7/00 40/593 |
| 8,898,820 | B2 | 12/2014 | Sokolowski et al. | |
| 2002/0053152 | A1 * | 5/2002 | Collins | G08B 5/006 40/586 |
| 2005/0150031 | A1 | 7/2005 | Schrader | |
| 2006/0147668 | A1 * | 7/2006 | Hirose | G09F 3/02 428/42.3 |
| 2006/0201036 | A1 | 9/2006 | Bardy | |
| 2008/0189830 | A1 | 8/2008 | Egglesfield | |
| 2010/0263247 | A1 * | 10/2010 | Liguori | G09F 3/10 40/542 |
| 2010/0306975 | A1 | 12/2010 | Greenspoon | |
| 2011/0047669 | A1 | 3/2011 | Carr | |
| 2012/0027988 | A1 | 2/2012 | Jurnovoy | |
| 2012/0040154 | A1 | 2/2012 | Dinescu et al. | |
| 2012/0174281 | A1 | 7/2012 | Mayer et al. | |
| 2012/0225257 | A1 | 9/2012 | Noda et al. | |
| 2014/0283283 | A1 | 9/2014 | Chumbler | |
| 2015/0096098 | A1 | 4/2015 | Zastocki | |

OTHER PUBLICATIONS

"Catalog: Leg Bib," Liski Sport Equipment, liski.it, 2013. http://www.liski.it/EN-en/catalogo.asp?Catalogo=&CatalogoId=22&Categoria=&CategoriaId=17&sottocategoria=LEG%20BIB&sottocategoriaid=4427.

"Our Products: Design Templates," Athlete Race Numbers, athleteracenumbers.com, 2011. https://orders.enviroprintusastore.com/athleteracenumbers/start_new_order.cgi?tab=Adhesive%20Numbers.

"Stick Label—Team Order of 16," Stinky Lockers™, stinkylockers.com, accessed: Oct. 2015. http://www.stinkylockers.com/stick-label-team-order-of-16/.

"Iron/Sew On Twill Letters(bulk)," Propatches USA, propatchesusa.com, accessed: Oct. 2015. http://www.propatchesusa.com/index.php?main_page=index&cPath=9&zenid=aa846b64434a33d74ac94b07a86aea1c.

International Search Report and Written Opinion dated Apr. 13, 2017 in International Patent Application No. PCT/US2016061132, 20 pages.

International Preliminary Report on Patentability and Written Opinion in PCT Application No. PCT/US2016/061132, dated May 24, 2018, 12 Pages.

Communication under Rule 71(3) EPC dated Apr. 23, 2019 in European Patent Application No. 16798350.1, 5 pages.

* cited by examiner

ATHLETIC BIB

CROSS-REFERENCE TO RELATED APPLICATIONS

This application having attorney docket number NIKE.264679/150946US02 and entitled "Athletic Bib," claims priority to U.S. Prov. App. No. 62/254,887, entitled "Athletic Bib," and filed Nov. 13, 2015. The entirety of the aforementioned application is incorporated by reference herein.

TECHNICAL FIELD

Aspects herein related to an athletic bib adapted to conform to a wearer's body surface and provide breathability and permeability characteristics.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed to an athletic bib configured to conform closely to a wearer's three-dimensional (3-D) surface shape, general body shape, and to the 3-D surface shape of an apparel item on which the bib is being worn. Moreover, the exemplary athletic bib described herein is further configured to promote air permeability and breathability. Typical athletic bibs are secured to a wearer using, for instance, safety pins at the corners of the bib. This fastening mechanism leaves loose edges that may potentially create drag points during wear and may distract the wearer by flapping during movement. In an exemplary aspect, in order to conform closely to a wearer's 3-D surface shape and/or to conform to the 3-D surface shape of a region of the apparel item on which the bib is being worn, the athletic bib may be formed from a flexible material, such as a knit material, that has a releasable adhesive on an inner-facing surface of the bib. The flexible nature of the material in combination with the releasable adhesive enables the bib to be uniformly adhered to an apparel item, such as a top, without leaving loose edges and further enables the bib to conform to the wearer's 3-D surface shape and/or to the surface shape of the region of the apparel item on which the bib is adhered.

In another exemplary aspect, the bib may be formed of a less expensive tightly woven material, a non-woven material, a paper-like material, and the like. Although these materials may exhibit a high degree of durability, they are typically less flexible or pliable as compared to, for example, the flexible material described above. To impart a degree of flexibility or pliability to the bib, a repeating pattern of slits may be formed through the thickness of the material. When adhered to the apparel item using the releasable adhesive, the slits enable the bib to more closely conform to the wearer's 3-D surface shape and/or to the surface shape of the apparel item in the region at which the bib is being applied. Moreover, as will be discussed below, the slits may impart a degree of breathability and/or permeability to the athletic bib.

To enable the athletic bib to mimic more closely a wearer's general body shape, the athletic bib described herein may be shaped such that the upper margin of the bib is longer than the lower margin of the bib (i.e., the bib generally tapers as it extends from its upper margin to its lower margin). Typically athletic bibs are worn on the chest area of an apparel item during athletic events. And in general, a wearer's natural shape is such that the chest is wider than the waist or lower torso area of the wearer. This may also hold true for other areas of the human body such as the thigh area (e.g., the thigh is wider at the top and tapers towards the knee area), the upper arm area (e.g., the arm is wider toward the shoulder and tapers toward the elbow), and the back area. To take advantage of this natural tapering, the bib is configured so that the upper margin of the bib is longer than the lower margin of the bib.

Although this shape configuration allows the bib to mimic more closely the wearer's general body shape, it may decrease the amount of surface area available on the bib to display sponsorship information, race information, logos, graphics, and the like. To increase the surface area without sacrificing the overall tapering shape of the bib, the side margins of the bib may be configured to initially extend away from a midline of the athletic bib before tapering towards the lower bib margin. The result is an athletic bib with a large surface area to display visual indicia while still maintaining a tapering shape that lessens potential drag points and minimizes wearer distractions due to, for instance, the lower margin of the bib overlying areas exhibiting motion during athletic events (e.g., the hip area when the bib is worn on the chest, the knee area when worn on the thigh, the elbow area when worn on the upper arm, and the like).

As stated above, the athletic bib described herein is further configured to promote breathability (e.g., the movement of water or moisture vapor through the bib) and/or air permeability (e.g., the movement of air through the bib). To promote breathability and permeability, in one exemplary aspect, the releasable adhesive may be selectively applied to the inner-facing surface of the bib such that it does not extend over the entire surface of the bib. Moreover, the athletic bib may comprise a plurality of perforations that extend through the thickness of the bib. In an additional example, the repeating pattern of slits described above may also promote breathability. In aspects, the bib may comprise the perforations by themselves, the slits by themselves, or the perforations may be used in combination with the slits to promote breathability.

BRIEF DESCRIPTION OF THE DRAWINGS

The present invention is described in detail below with reference to the attached drawing figures, wherein.

DETAILED DESCRIPTION

Figure 1:
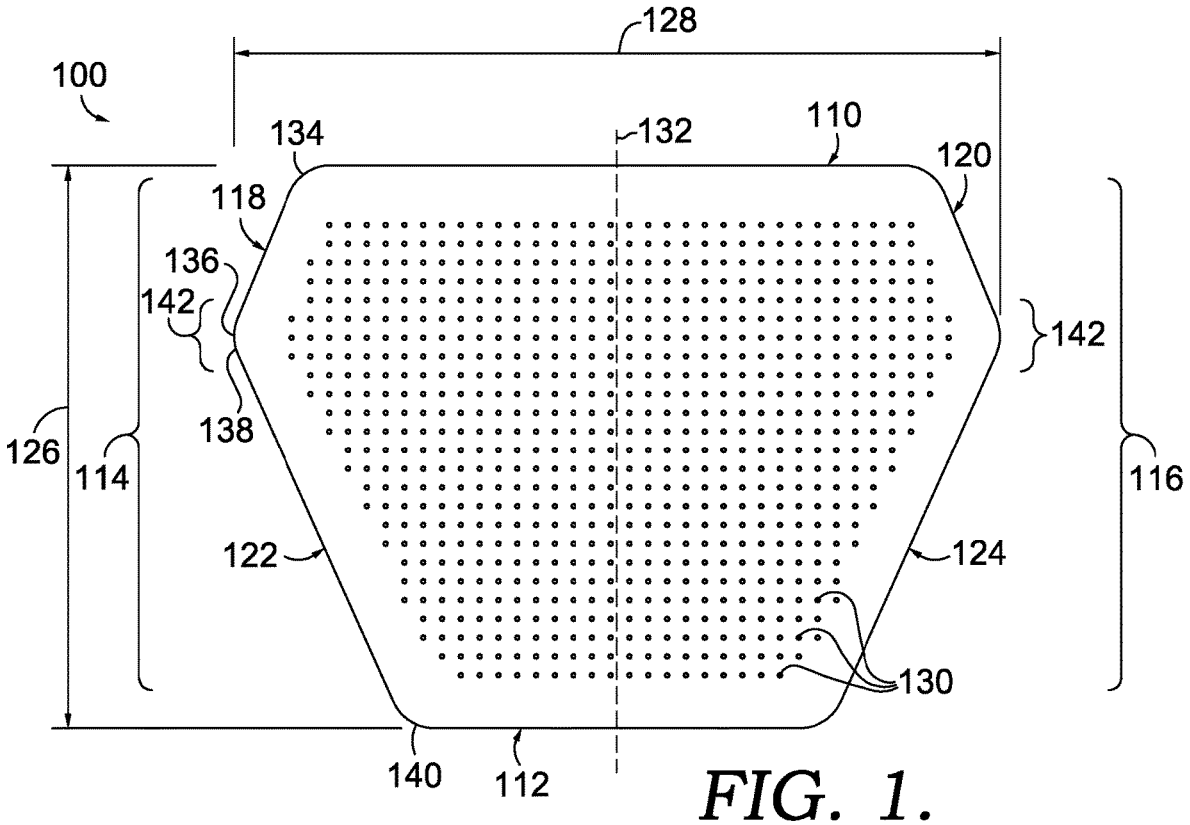
FIG. 1 depicts a face view of an exemplary athletic bib in accordance with aspects herein.

The subject matter of the present invention is described with specificity herein to meet statutory requirements. However, the description itself is not intended to limit the scope of this disclosure. Rather, the inventors have contemplated that the described and claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein provide for an athletic bib to be worn during athletic events, especially sponsored athletic events. In exemplary aspects, the bib is configured to minimize wearer distractions and to reduce or eliminate potential drag points by conforming closely to a wearer's 3-D surface shape and/or by conforming closely to the 3-D surface shape of a region of the apparel item to which the bib is applied. The ability to conform closely to the wearer's or the apparel item's 3-D surface shape may be based on, for example, use of a releasable adhesive to uniformly affix the bib to the apparel item (as opposed to, for instance, typical assemblies where safety pins are used to secure the corners of the bib to the apparel item). The ability to conform closely to the wearer's or apparel item's 3-D surface shape may also be based on the type of material used to form the bib. For instance, the bib may be formed from a flexible material, such as a knit material, that has sufficient pliability to easily conform to different three-dimensional surfaces. Although a knit material is provided as an example of a flexible material herein, it is contemplated that the flexible material may comprise a flexible woven or non-woven material.

In another example, the bib may be formed from a tightly woven, non-woven, or paper material that exhibits high durability but may be less pliable than the flexible material discussed herein. To impart pliability to these materials, a repeating pattern of slits may be formed through the bib material. The slits enable the bib to more closely conform to the wearer's and/or the apparel item's 3-D surface shape.

In another example, the perimeter shape of the bib may be configured to align more closely with a wearer's natural body shape. During athletic events, bibs are generally located on the chest area, the back area, the upper arm area, and/or the back area of a wearer. In each of these locations, there is generally a natural tapering from an upper or more proximal portion to a lower or more distal portion. For instance, the mid-chest area of a wearer is typically broader or wider than the waist area of the wearer. To take advantage of this natural tapering, the exemplary athletic bib described herein may be configured such that the upper margin of the bib is longer than the lower margin of the bib. However, to maximize the amount of real estate on the bib available for sponsorship, logos, graphics, race information, or other visual indicia, the side margins of the bib may be configured to initially extend away from the midline of the bib before tapering back in at the lower margin of the bib.

Continuing, in exemplary aspects, the athletic bib described herein is further configured to promote breathability and/or air permeability. This may be important considering that the bib described herein more closely conforms to the wearer's or the apparel item's 3-D surface shape as opposed to more conventional bibs that are loosely secured to apparel items via, for instance, safety pins. Moreover, without configuring the bib such that the bib exhibits breathability and/or permeability characteristics, the bib may impede or decrease the breathable characteristics of the underlying apparel item. Because adhesives generally exhibit low breathability and permeability characteristics, breathability and permeability of the bib may be facilitated by selectively applying the releasable adhesive to the inner-facing surface of the bib as opposed to using an adhesive sheet or film. As used throughout this disclosure, the term "selectively apply" means that the releasable adhesive is applied to portions of the surface but is not applied to an entirety of the surface. The result of selectively applying the releasable adhesive is that the inner-facing surface of the bib has areas that are not covered by the adhesive, where these areas may exhibit higher rates of moisture vapor transmission and air transmission as opposed to those areas covered by the releasable adhesive. Breathability and permeability of the bib may be further enhanced by forming perforations through the bib. On a similar note, the slits described above may also promote breathability and permeability of the athletic bib.

Accordingly, aspects herein provide for an athletic bib. The athletic bib comprises a panel defined by a perimeter shape comprising: an upper margin having a first length; a lower margin having a second length less than the first length, wherein the lower margin is parallel to the upper margin: a right side margin joining a first end of the upper margin to a first end of the lower margin; and a left side margin joining a second end of the upper margin to a second end of the lower margin, wherein the right side margin and the left side margin each comprise a first portion extending away from a midline bisecting the athletic bib into right and left halves and a second portion extending toward the midline.

In another exemplary aspect, an athletic bib is provided comprising a panel having an outer-facing surface and an inner-facing surface, where the panel has applied thereon a repeating pattern of slits extending from the outer-facing surface through the inner-facing surface of the panel; a releasable adhesive applied to the inner-facing surface of the panel; and visual indicia applied to the outer-facing surface of the panel.

In yet another aspect, a kit for an athletic bib is provided. The kit comprises a transport layer formed from a relatively rigid substrate; a carrier layer having a first surface and a second surface, where the second surface of the carrier layer is secured to the transport layer; and a panel comprising the athletic bib, where the panel comprises a third surface and a fourth surface, and where the third surface of the panel is releasably secured to the first surface of the carrier layer, and where the athletic bib comprises a plurality of perforations extending through a thickness of the panel.

Turning now to FIG. 1, FIG. 1 depicts a face view of an exemplary athletic bib 100 in accordance with aspects herein (e.g., a view of the outer-facing surface of the bib 100 when worn). In exemplary aspects, the athletic bib 100 may preferably be formed from a material that exhibits a high degree of flexibility or pliability such that it can easily conform to different 3-D surfaces. Exemplary materials may comprise, for instance, flexible knit, woven, or non-woven textiles, polyurethane materials, silicone materials, and the like.

As shown in FIG. 1, the athletic bib 100 may be defined by a perimeter shape comprising an upper margin 110, a lower margin 112 that is in parallel alignment with the upper margin 110, a right side margin 114, and a left side margin 116. In exemplary aspects, the upper margin 110 has a longer length than the lower margin 112. For instance, the lower margin 112 may be two-thirds to three-fourths the length of the upper margin 110. The lower margin 112 is spaced apart from the upper margin 110 by a distance 126. In exemplary aspects, the distance 126 may comprise, for example, between 7 cm to 20 cm. Further, in exemplary aspects, the distance 126 may comprise at least 17 cm. Moreover, the distance 126 may be selected based on where the bib 100 will be worn (e.g., the distance 126 may be smaller when the bib 100 is worn on the upper arm or upper thigh area), and/or based on whether the bib 100 will be worn by a male or female competitor (e.g., the distance 126 may be decreased when the bib 100 is worn by a female competitor). In further aspects, the distance 126 may be based on the type of apparel on which the bib 100 will be worn, and/or the type of athletic event for which the bib 100 will be used. Any and all aspects, and any variation thereof, are contemplated as being within the scope herein.

Each of the right side margin 114 and the left side margin 116 may comprise a first portion 118 and 120 respectively, and a second portion 122 and 124 respectively. The first portion 118 of the right side margin 114 comprises a first end 134 and a second end 136, where the first end 134 extends away from the upper margin 110 towards the second end 136. To put it another way, the first portion 118 of the right side margin 114 extends away from a midline 132 that bisects the bib 100 into equal right and left halves. A similar configuration would hold true for the first portion 120 of the left side margin 116.

Continuing, the second portion 122 of the right side margin 114 comprises a first end 138 and a second end 140, where the first end 138 extends from the second end 136 of the first portion 118 and the second end 140 intersects the lower margin 112. The second portion 122 of the right side margin 114 extends towards the midline 132. A similar configuration would hold true for the left side margin 116.

As shown in FIG. 1, an apex region 142 is formed where the second end 136 of the first portion 118 intersects the first end 138 of the second portion 122. A similar apex region 142 would be formed at the left side margin 116. In exemplary aspects, the second portions 122 and 124 may be slightly longer in length than the first portions 118 and 120. This configuration causes the apex region 142 to be located closer to the upper margin 110 as compared to the lower margin 112. This is shown in FIG. 1. However, it is contemplated herein that the first portions 118 and 120 may be the same length as the second portions 122 and 124 causing the apex region 142 to be located at approximately the horizontal midline of the bib 100. Or the first portions 118 and 120 may have a longer length than the second portions 122 and 124 causing the apex region 142 to be shifted closer to the lower margin 112. Moreover, in exemplary aspects, the apex region 142 may comprise a defined point or may be more rounded as shown in FIG. 1. Any and all aspects, and any variation thereof, are contemplated as being within the scope herein.

The apex region 142 of the right side margin 114 is spaced apart from the apex region 142 of the left side margin 116 by a distance 128. In exemplary aspects, the distance 128 may comprise, for example, between 7 cm to 20 cm. Further, in exemplary aspects, the distance 128 may comprise at least 17 cm. Moreover, the distance 128 may be selected based on where the bib 100 will be worn (e.g., the distance 128 may be smaller when the bib 100 is worn on the upper arm or upper thigh area), based on whether the bib 100 will be worn by a male or female competitor (e.g., the distance 128 may be decreased when the bib 100 is worn by a female competitor), based on the type of apparel on which the bib 100 will be worn, and/or the type of athletic event for which the bib 100 will be used. Any and all aspects, and any variation thereof, are contemplated as being within the scope herein.

The perimeter shape defined by the upper margin 110, the lower margin 112, the right side margin 114, and the left side margin 116 creates a large amount of surface area or real estate for displaying visual indicia (not shown). More particularly, by configuring the right and left side margins 114 and 116 as described to form the apex region 142, the surface area of the athletic bib 100 is increased while still maintaining the overall tapering shape of the bib 100. The visual indicia may comprise sponsorship information, logos, graphics, and/or required race information (e.g., race number, heat number, and the like). Moreover, the tapering shape of the bib 100 corresponds to the natural anatomical tapering of different body areas on which the bib 100 overlies when worn. As such, the result is a low-profile athletic bib that still maximizes the opportunity for sponsorship, logos, graphics, and/or race information to be displayed.

As further shown in FIG. 1, the bib 100 comprises a plurality of perforations 130 that extend through the thickness of the material forming the bib 100. As described above, the perforations 130 help provide a threshold level of breathability and permeability to the athletic bib 100. The perforations 130 are located over a majority of the bib 100. For instance, in exemplary aspects, the perforations 130 may extend over 50% to 100% of the surface area of the bib 100. The perforations 130, in one exemplary aspect, may extend to the upper margin 110, the lower margin 112, the right side margin 114, and the left side margin 116, or the perforations 130 may stop a predetermined distance away from the margins 110, 112, 114, and 116 leaving a perimeter border around the perforations 130. Any and all aspects, and any variation thereof, are contemplated as being within the scope herein. Each perforation 130 may be sized and distributed across the bib 100 to provide at least a threshold level of breathability and/or air permeability. Exemplary diameters for the perforations 130 may comprise 2 mm, 3 mm, 4 mm, or 5 mm, although diameters above and below these values are contemplated herein.

Figure 2:
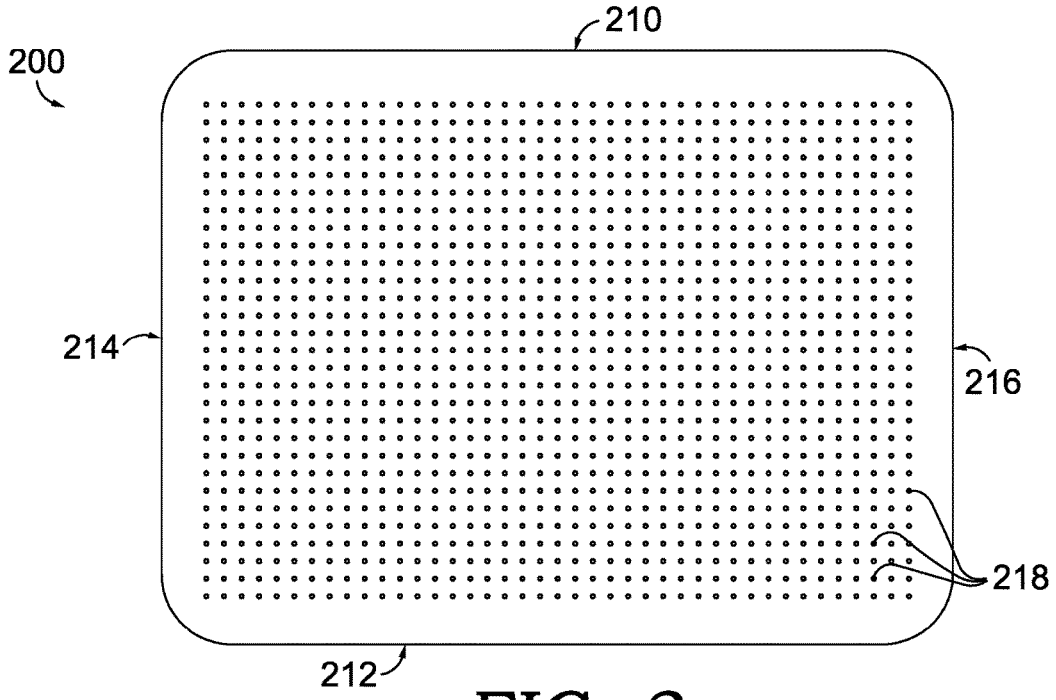
FIG. 2 depicts a face view of an exemplary athletic bib in accordance with aspects herein.

FIG. 2 depicts an alternative shape configuration for an exemplary athletic bib 200 in accordance with aspects herein. Similar to the athletic bib 100, the athletic bib 200 may preferably be formed from a material exhibiting a high degree of pliability such as a knit, woven, or non-woven material.

The athletic bib 200 has a rectangular shape with an upper margin 210, a lower margin 212, a right side margin 214, and a left side margin 216. In exemplary aspects, the upper margin 210 and the lower margin 212 are in parallel alignment, and the right side margin 214 and the left side margin 216 are in parallel alignment. The upper margin 210 may be spaced apart from the lower margin 212 by a distance between, for example, 7 cm to 20 cm. Similarly, the right side margin 214 may be spaced apart from the left side margin 216 by a distance between, for instance, 7 cm to 20 cm. Any and all aspects, and any variation thereof, are contemplated as being within the scope herein.

The athletic bib 200 may comprise a plurality of perforations 218 that extend through the thickness of the material forming the bib 200. Similar to the athletic bib 100, the perforations 218 may extend over 50% to 100% of the surface area of the bib 200. The perforations 218, in one exemplary aspect, may extend to the upper margin 210, the lower margin 212, the right side margin 214, and the left side margin 216, or the perforations 218 may stop a predetermined distance away from the margins 210, 212, 214, and 216 leaving a perimeter border around the perforations 218. Any and all aspects, and any variation thereof, are contemplated as being within the scope herein. Each perforation 218 may be sized and distributed to provide at least a threshold level of breathability and/or air permeability to the bib 200. Exemplary diameters for the perforations 218 may comprise 2 mm, 3 mm, 4 mm, or 5 mm, although diameters above and below these values are contemplated herein. In exemplary aspects, visual indicia may be printed on the outer-facing surface of the bib 200, where the visual indicia may comprise sponsorship information, logos, graphics, race information, or other visual indicia.

Figure 3:
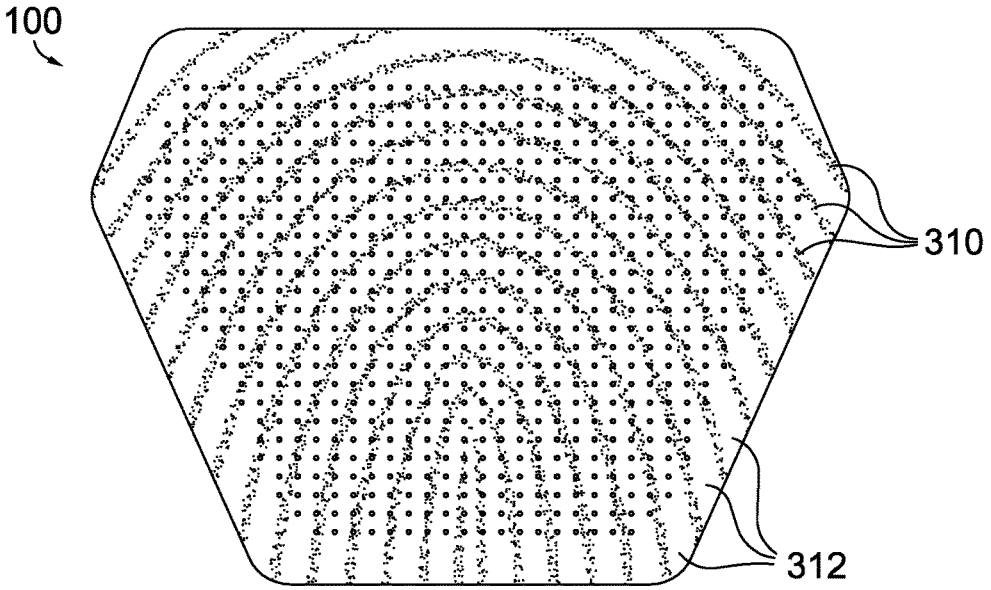
FIG. 3 depicts a back view of an exemplary athletic bib in accordance with aspects herein.

FIG. 3 depicts a back-facing view of the athletic bib 100 in accordance with aspects herein. The discussion with respect to FIG. 3 is equally applicable to the athletic bib 200. In exemplary aspects, to provide a threshold level of breathability and/or air permeability, an adhesive 310 is selectively applied to the back-facing surface of the bib 100. Thus, instead of applying an adhesive such that it overlies the entire back-facing surface of the bib 100, the adhesive 310 is only applied to selected areas as shown. By selectively applying the adhesive 310, portions of the back-facing surface of the bib 100 are left uncovered by adhesive as indicated by the reference numeral 312. These uncovered portions 312 may work in concert with the breathability characteristics of the underlying apparel item on which the bib 100 is being worn to facilitate the passage of moisture vapor generated by the wearer through the bib 100.

In exemplary aspects, the adhesive 310 may be applied to 95%, 90%, 85%, 80% or 75% of the back-facing surface of the bib 100. The adhesive 310 may comprise a releasable and reusable adhesive that resists sweat. Exemplary adhesives may comprise, for instance, acrylates including methyacrylates and epoxy diacrylates (also known as vinyl resins). An exemplary adhesive may be produced by Nitto Denko® Corporation in Osaka, Japan.

Figure 4:
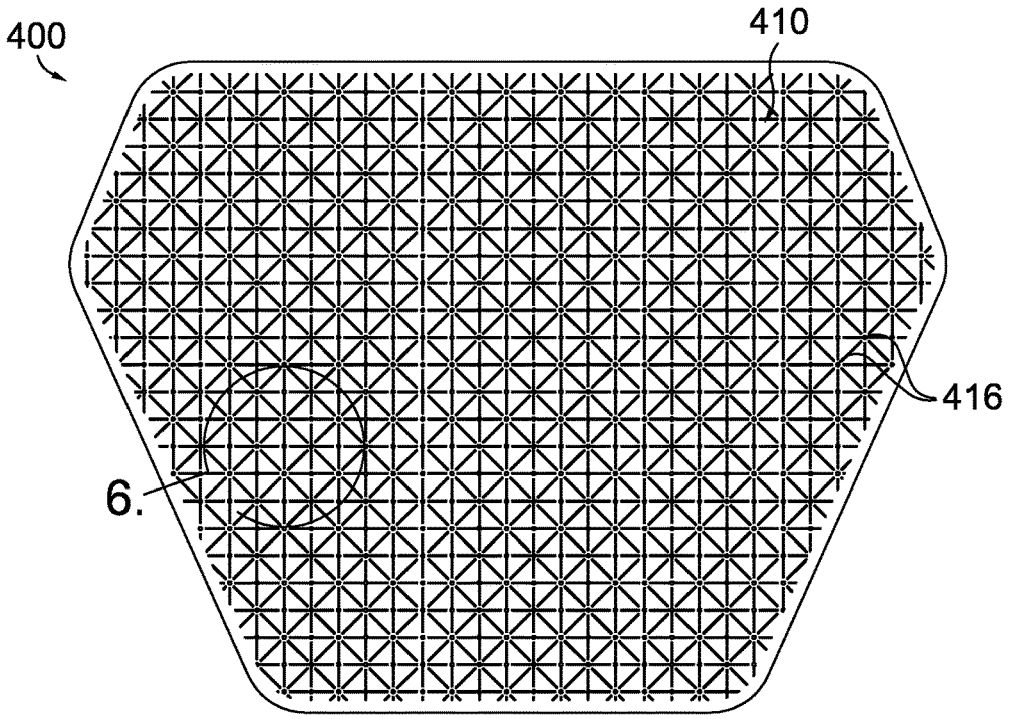
FIG. 4 depicts a face view of an exemplary athletic bib in accordance with aspects herein.

Turning now to FIG. 4, an exemplary athletic bib 400 is shown in accordance with aspects herein. In exemplary aspects, the bib 400 may preferably be formed from a tightly woven, non-woven, or paper-like material, or the bib 400 may be formed from a pliable material similar to that used to form, for instance, the athletic bib 100. Exemplary bibs formed from tightly woven, non-woven, or paper-like materials may be cheaper to produce than their knit counterparts, and, additionally, are often very durable (e.g., resist tearing). However, they may not be as flexible or pliable as, for instance, bibs formed from the flexible materials described herein.

The bib 400 may have a perimeter shape similar to that shown for the athletic bib 100 and, as such, the discussion regarding the perimeter shape of the bib 100 is equally applicable to the bib 400. Moreover, the bib 400 may have similar sizes/dimensions as those discussed for the athletic bib 100.

Figure 6:
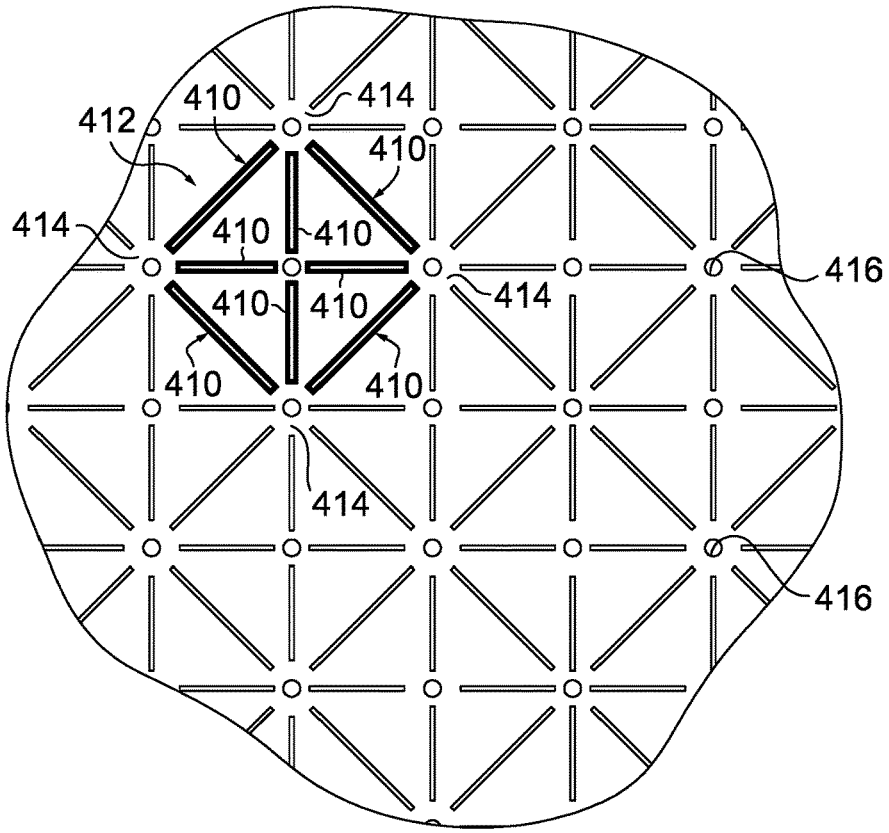
FIG. 6 depicts a close-up view of the exemplary athletic bib of FIGS. 4 and 5 in accordance with aspects herein.

Because the material used to form the bib 400 may lack a high degree of flexibility or pliability, a repeating pattern of slits 410 may be formed such that the slits 410 extend through the thickness of the athletic bib 400. A close-up view of the exemplary pattern of slits 410 is illustrated in FIG. 6. In this aspect, the pattern of slits 410 are formed along a repeating set of convex quadrilateral shapes (e.g., diamond shapes). A representative quadrilateral shape is indicated by the bolded lines in FIG. 6 and is referenced by the numeral 412. Slits 410 are also formed along the diagonals between each pair of opposing vertices of each quadrilateral shape. More particularly, two slits 410 may be formed along each diagonal in each quadrilateral shape. These two slits do not interest at a mid-point of the diagonal. In other words, the two slits 410 are spaced a distance away from the midpoint as indicated by the reference numeral 414, where the midpoint of the diagonal corresponds to the centroid of the quadrilateral shape. Exemplary spacing distances for the two slits 410 may comprise between 1 and 7 mm. Continuing, in exemplary aspects, the slits 410 along the edges of each quadrilateral shape and along the diagonals are spaced a distance (e.g., between 1 mm and 7 mm) away from the vertices of the quadrilateral shape as indicated by the reference numeral 414. The edges of each of the quadrilateral shapes may have approximately the same length, and the slits 410 formed along the edges may have approximately the same length. Continuing, the length of each diagonal in each quadrilateral shape may have approximately the same length, and the length of the slits 410 formed along these diagonals may be approximately the same.

By using the slits 410, flexibility or pliability is imparted to the bib 400 such that the bib 400 can drape and conform to a 3-D structure such as the human body or an apparel item. This is because each slit 410 acts as a hinge and material on either side of the slit 410 can independently flex or move out of the plane (e.g., in both a positive and negative z-direction) of the bib 400. Moreover, the slit configuration shown in FIGS. 4 and 6 also helps to maintain the structural integrity of the bib 400 after it is removed from, for instance, a carrier layer and prior to adhering the bib 400 to an apparel item. For example, if the slits 410 were instead arranged in a repeating pattern of parallel slits, this configuration may cause the bib 400 to rip, tear, or be too flexible such that it could not easily be transported from the carrier layer to the apparel item. The pattern shown in FIG. 6 is exemplary only and it is contemplated herein that other lattice-like patterns may be used to impart pliability to the bib 400.

Continuing with respect to FIGS. 4 and 6, the bib 400 may optionally comprise perforations 416 to further provide a threshold level of breathability and/or air permeability to the bib 400. In exemplary aspects, the perforations 416 may optionally be located at each vertex of the quadrilateral shape. In another example, the perforations 416 may optionally be located at the centroid of each quadrilateral shape.

Referring now more specifically to FIG. 4, the patterns of slits 410, in exemplary aspects may extend substantially over the entirety of the bib 400. As an example and as shown in FIG. 4, the slits 410 may extend up to the margins of the bib 400 with just a small amount of material forming a perimeter border of the bib 400. In other exemplary aspects, the slits 410 may extend up to a predetermined distance away from the margins of the bib 400 such that a larger perimeter border of material surrounds the slits 410. In exemplary aspects, the slits may extend over 50%, 60%, 70%, 80%, 90%, or 95% of the bib 400. Any and all aspects, and any variation thereof, are contemplated as being within the scope herein.

Figure 5:
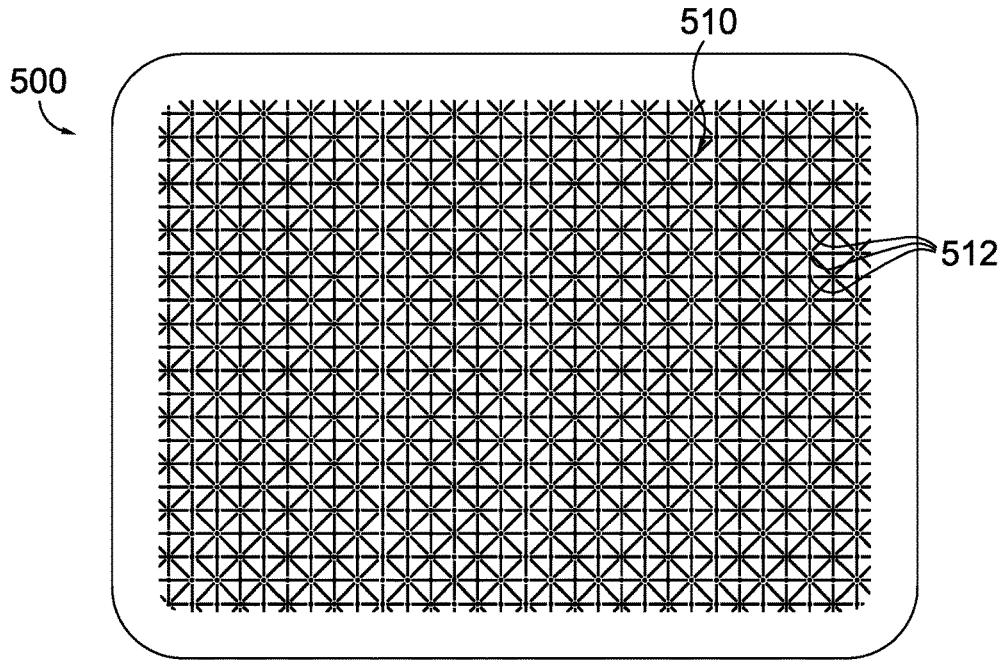
FIG. 5 depicts a face view of an exemplary athletic bib in accordance with aspects herein.

FIG. 5 depicts an alternative shape configuration for the bib 400 in accordance with aspects herein. As shown in FIG. 5, the bib 500 may have a more rectangular shape similar to that shown for the bib 200 in FIG. 2. The bib 500 may preferably be formed from the tightly woven, non-woven, or paper-like material of the bib 400, or it may be formed from a more flexible material. The discussion regarding the shape and the size of the bib 200 is equally applicable to the bib 500.

Similar to the bib 400, the bib 500 may comprise a pattern of slits 510 that cover the majority of the surface of the bib 500. For instance, in exemplary aspects, the slits may extend over 50%, 60%, 70%, 80%, 90%, or 95% of the bib 500. Further, similar to the bib 400, the bib 500 may optionally comprise a plurality of perforations 512 to promote breathability of the bib 500.

Figure 7:
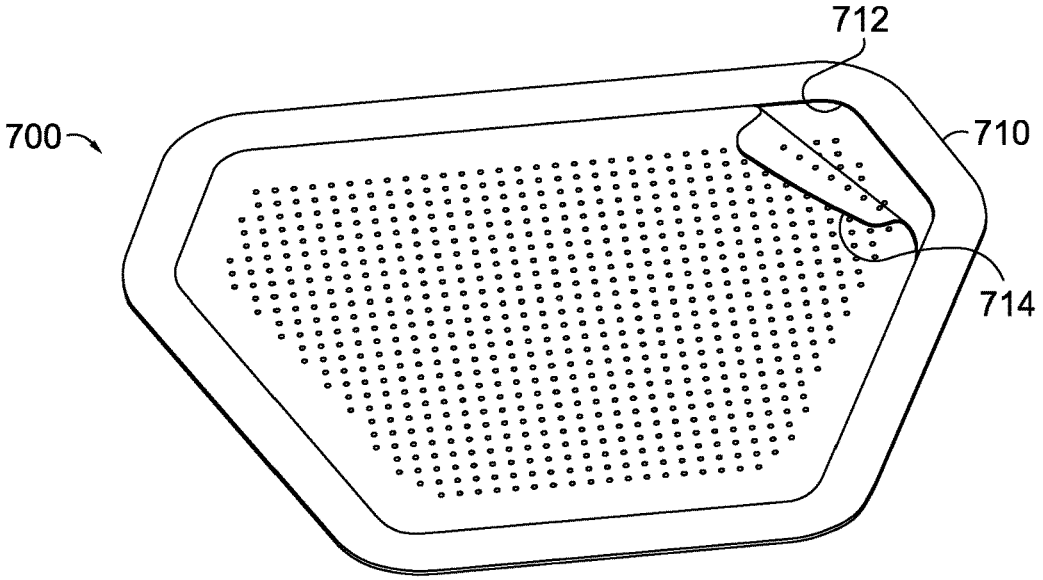
FIG. 7 depicts an exemplary kit for an athletic bib in accordance with aspects herein.

FIG. 7 depicts an exemplary athletic bib kit 700 in accordance with aspects herein. The kit 700 may be produced by a manufacturer and distributed to various athletic events, vendors, and/or to individual athletes. In exemplary aspects, the kit 700 may comprise an optional transport layer 710, a carrier layer 712, and an athletic bib 714 as described herein.

In exemplary aspects, the optional transport layer 710 may be formed from a relatively stiff or rigid material such as cardboard that helps keep the athletic bib 714 from being damaged during shipping and transport. The carrier layer 712 comprises a temporary layer that is secured to the inner-facing surface of the bib 714 via, for example, the adhesive that is located on the inner-facing surface of the bib 714. The carrier layer 712 protects the adhesive and prevents the adhesive from inadvertently adhering to unwanted items. The carrier layer 712, in exemplary aspects, may be formed from a paper material with a release coating to prevent the adhesive on the bib 714 from sticking permanently to the carrier layer 712.

The athletic bib 714 (shown with one corner folded over) may comprise any of the athletic bibs 100, 200, 400, or 500 described herein. As such, the athletic bib 714 may comprise a rectangular shape such as the athletic bib 200 or the athletic bib 500. Alternatively, the athletic bib 714 may have a shape similar to that shown for the athletic bib 100 or the athletic bib 400. In exemplary aspects, the carrier layer 712 and the transport layer 710 may have a similar shape configuration as the athletic bib 714. With respect to this aspect, the transport layer 710 may be larger than the carrier layer 712 and the athletic bib 714. By configuring the transport layer 710 to be larger than the athletic bib 714, the bib 714 is further protected from damage during shipping and transport. The kit 700 may comprise additional components not shown such as an instruction sheet, a plastic wrap encasing the kit 700, and the like.

Figure 8:
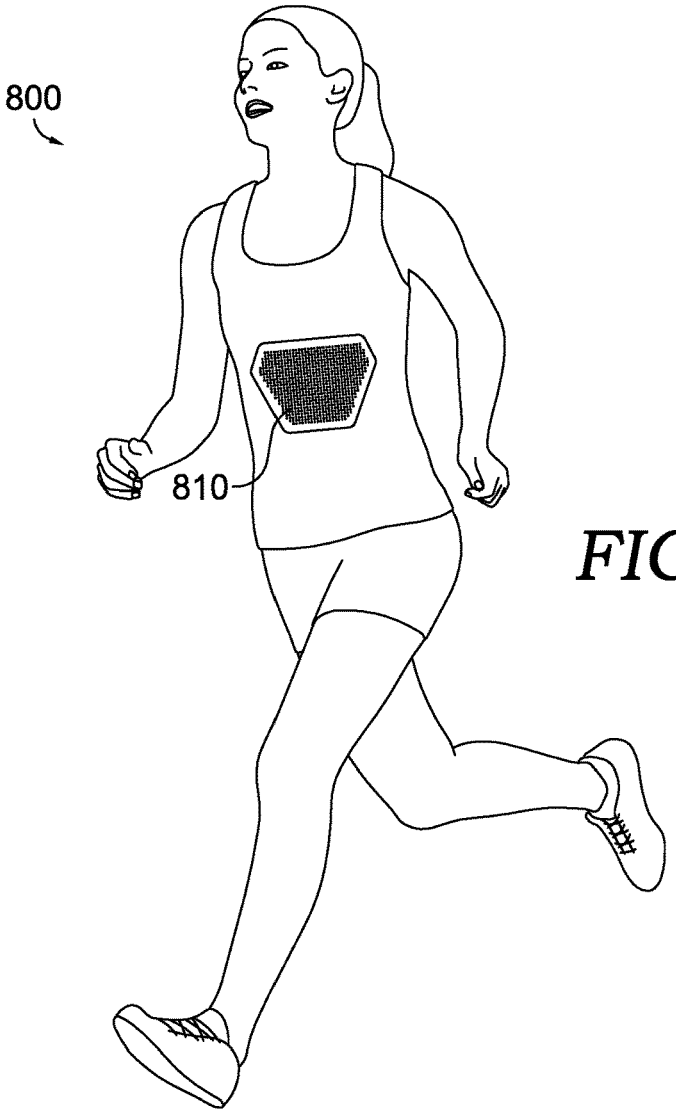
FIG. 8 depicts an exemplary athletic bib being worn by a wearer in accordance with aspects herein.

FIG. 8 depicts an exemplary athletic bib 810 as described herein being worn by a wearer 800. As shown, the athletic bib 810 is sized and shaped to be worn on the front of a shirt. The tapering shape of the bib 810 generally corresponds to the anatomical shape of the wearer 800. Moreover, use of the releasable adhesive, the selection of the material used to form the bib 810, and/or the use of a slit pattern, enables the athletic bib 810 to closely conform to the wearer's 3-D surface shape and/or to the 3-D surface shape of an apparel item on which the bib 810 is being worn. The perimeter shape of the bib 810 provides for a large amount of surface area for displaying visual indicia while still maintaining the tapered silhouette. Although shown on the chest area of the wearer 800, it is contemplated herein that the bib 810 may be sized to conform to the wearer's arm, leg, and/or back. The bib 810 is shown as comprising a plurality of perforations that facilitate breathability of the bib.

Figure 9:
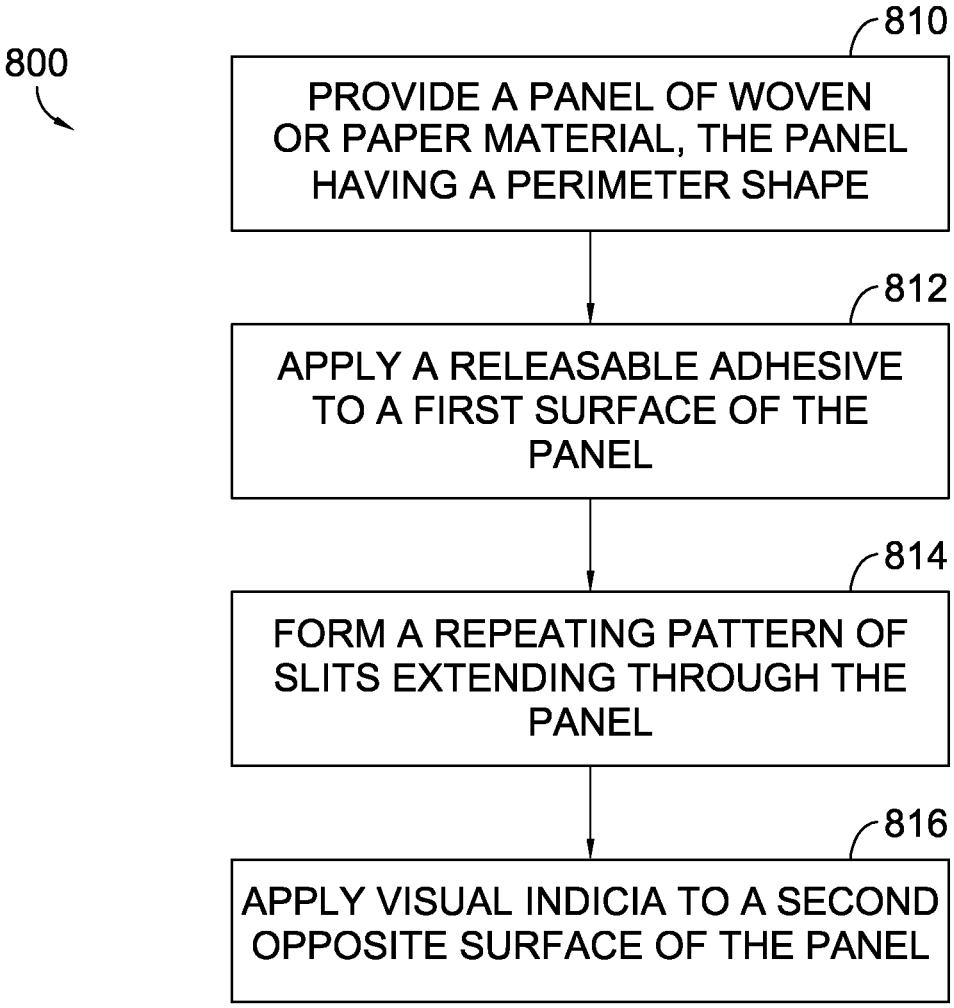
FIGS. 9-10 are flow diagrams of exemplary methods of manufacturing an athletic bib in accordance with aspects herein.

FIG. 9 is a flow diagram of an exemplary method 900 of manufacturing an athletic bib in accordance with aspects herein. At a step 910, a panel of tightly woven or paper material is provided. The panel may be defined by a perimeter shape corresponding to, for instance the perimeter shape of the bib 100 or 400, or the bib 200 or 500. At a step 912, a releasable adhesive is applied to a first surface of the panel. In exemplary aspects, the releasable adhesive may be applied as a sheet or film that overlies the first surface of the panel. In other exemplary aspects, the releasable adhesive may be brushed on, rolled on, or sprayed on the first surface of the panel. As an additional part of step 912, a carrier layer or sheet may be applied to the panel such that the carrier layer overlies the releasable adhesive.

At a step 914, a repeating pattern of slits is formed in the panel, where the slits extend through the thickness of the material forming the panel. The slits may be formed by, for example, laser cutting, water-jet cutting, ultrasonic cutting, die cutting, and the like. As an additional part of step 914, perforations may be formed in the panel such that the perforations are located in areas between the slits. The perforations may be formed using one of the processes outline above. And, at a step 916, visual indicia are applied to a second surface of the athletic bib, where the second surface is opposite of the first surface. The visual indicia may comprise logos, sponsorship information, graphics, event information, and the like and may be based on, for instance, rostering information specific to an athletic event (e.g., track and field events, Olympic events, and the like). The visual indicia may be printed on the athletic bib using known methods in the art. The method 900 may further comprise packaging the athletic bib as a kit as described above with respect to FIG. 7

Figure 10:
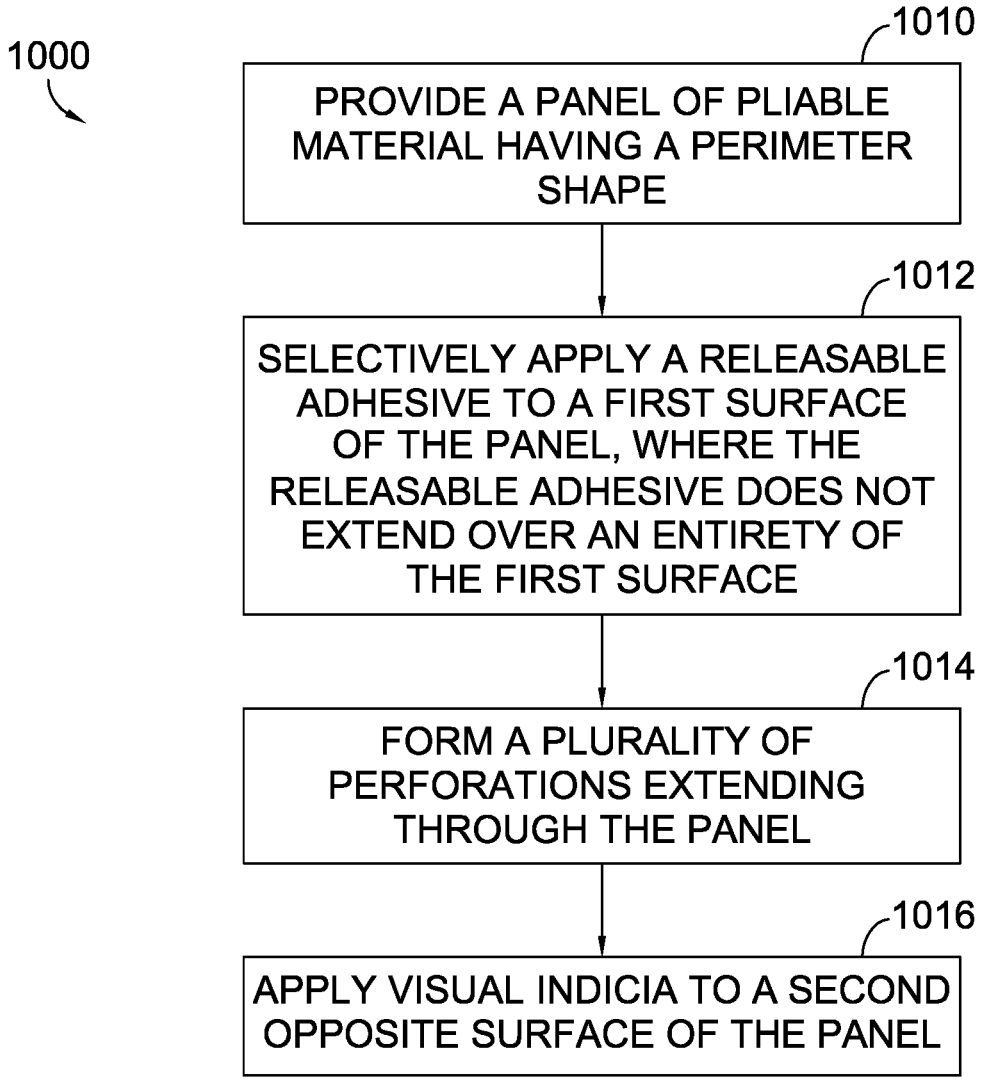

FIG. 10 is flow diagram of another exemplary method 1000 of manufacturing an athletic bib in accordance with aspects herein. At a step 1010, a panel of pliable material is provided, where the material has sufficient pliability to conform to different three-dimensional surfaces. In exemplary aspects, the pliable material may comprise a knit material. The panel may be defined by a perimeter shape corresponding to, for instance the perimeter shape of the bib 100 or 400, or the bib 200 or 500. At a step 1012, a releasable adhesive is selectively applied to a first surface of the panel such that portions of the first surface are not covered by the adhesive. For instance, the adhesive may be applied in a grid-like pattern, a series of undulating lines, a series of straight lines, a dot matrix pattern, and the like. In one aspect, the adhesive may be applied via a screen printing process although other processes are contemplated herein (spray painting, rolling, brushing, and the like). As an additional part of step 1012, a carrier layer or sheet may be applied to the panel such that the carrier layer overlies the releasable adhesive.

At a step 1014, a plurality of perforations are formed through the material forming the panel. The perforations may be formed via hole punching, laser cutting, die cutting, water-jet cutting, ultrasonic cutting, and the like. And at a step 1016, visual indicia are applied to a second surface of the athletic bib, where the second surface is opposite of the first surface. The method 1000 may further comprise packaging the athletic bib as a kit as described above with respect to FIG. 7.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. An athletic bib comprising:

a panel defined by a perimeter shape comprising:

an upper margin having a first length;

a lower margin having a second length less than the first length, wherein the lower margin is parallel to the upper margin;

a right side margin joining a first end of the upper margin to a first end of the lower margin, the right side margin formed by a first portion having a first end extending from the first end of the upper margin, the first portion extending away from a midline bisecting the panel into right and left halves and terminating at a second end, the right side margin further formed by a second portion having a first end extending from the second end of the first portion, the second portion extending toward the midline and terminating at a second end that extends from the first end of the lower margin, wherein the first portion and the second portion of the right side margin meet at a first apex region; and a left side margin joining a second end of the upper margin to a second end of the lower margin, the left side margin formed by a first portion having a first end extending from the second end of the upper margin, the first portion extending away from the midline and terminating at a second end, the left side margin further formed by a second portion having a first end extending from the second end of the first portion, the second portion extending toward the midline and terminating at a second end that extends from the second end of the lower margin, wherein the first portion and the second portion of the left side margin meet at a second apex region.

2. The athletic bib of claim 1, wherein the first portion of the left and right side margins has a third length, and wherein the second portion of the left and right side margins has a fourth length, and wherein the third length is less than the fourth length.

3. The athletic bib of claim 1, wherein the panel is formed from one of a knit material, a paper material, a woven material, or a non-woven material.

4. The athletic bib of claim 1, wherein the panel comprises a plurality of perforations extending through a thickness of the panel.

5. The athletic bib of claim 4, wherein the panel comprises a repeating pattern of slits extending from an outer-facing surface through an inner-facing surface of the panel.

6. The athletic bib of claim 5, wherein the repeating pattern of slits extends over at least 50% of the surface of the panel.

7. The athletic bib of claim 6, wherein the repeating pattern of slits are arranged to form repeating sets of convex quadrilateral shapes.

8. The athletic bib of claim 1, wherein an adhesive is selectively applied to an inner-facing surface of the panel.

9. The athletic bib of claim 8, wherein the adhesive comprises a releasable adhesive.

10. The athletic bib of claim 1, wherein visual indicia are printed on an outer-facing surface of the panel.

11. The athletic bib of claim 1, wherein the athletic bib is adapted to be affixed to an apparel item configured for an upper torso of a wearer or a lower torso of the wearer, and wherein the athletic bib is adapted to overlie a chest area, a back area, an arm area, or a thigh area of the wearer when the athletic bib is affixed to the apparel item.

12. A kit for an athletic bib, the kit comprising:

a transport layer formed from a relatively rigid substrate;

a carrier layer having a first surface and a second surface, wherein the second surface of the carrier layer is secured to the transport layer; and a panel comprising the athletic bib, wherein:

the panel comprises a third surface and a fourth surface, the third surface of the panel is releasably secured to the first surface of the carrier layer, the panel comprises a plurality of perforations extending through a thickness of the panel, and wherein the plurality of perforations extends over at least 50% of the panel, and the panel is defined by a perimeter shape comprising:

an upper margin having a first length, a lower margin having a second length less than the first length, wherein the lower margin is parallel to the upper margin, a right side margin joining a first end of the upper margin to a first end of the lower margin, the right side margin formed by a first portion having a first end extending from the first end of the upper margin, the first portion extending away from a midline bisecting the panel into right and left halves and terminating at a second end, the right side margin further formed by a second portion having a first end extending from the second end of the first portion, the second portion extending toward the midline and terminating at a second end that extends from the first end of the lower margin, wherein the first portion and the second portion of the right side margin meet at a first apex region, and a left side margin joining a second end of the upper margin to a second end of the lower margin, the left side margin formed by a first portion having a first end extending from the second end of the upper margin, the first portion extending away from the midline and terminating at a second end, the left side margin further formed by a second portion having a first end extending from the second end of the first portion, the second portion extending toward the midline and terminating at a second end that extends from the second end of the lower margin, wherein the first portion and the second portion of the left side margin meet at a second apex region.

13. The kit of claim 12, wherein the athletic bib further comprises a repeating pattern of slits extending through the thickness of the panel.

14. The kit of claim 12, wherein the third surface of the panel is releasably secured to the first surface of the carrier layer via a releasable adhesive that is selectively applied to the third surface of the panel.

15. The kit of claim 12, wherein visual indicia are printed on the fourth surface of the panel.

16. The kit of claim 12, wherein the transport layer and the carrier layer have a same perimeter shape as the panel.

* * * * *